US010260846B1

(12) United States Patent
Fish

(10) Patent No.: US 10,260,846 B1
(45) Date of Patent: Apr. 16, 2019

(54) CONSUMER-READY PYROTECHNIC DISPLAY SYSTEM AND CONTROL MODULE THEREFOR

(71) Applicant: James E. Fish, Simpsonville, SC (US)

(72) Inventor: James E. Fish, Simpsonville, SC (US)

( * ) Notice: Subject to any disclaimer, the term of this patent is extended or adjusted under 35 U.S.C. 154(b) by 0 days.

(21) Appl. No.: 15/703,799

(22) Filed: Sep. 13, 2017

Related U.S. Application Data

(60) Provisional application No. 62/395,330, filed on Sep. 15, 2016.

(51) Int. Cl.

| | |
|---|---|
| ***F42B 4/24*** | (2006.01) |
| ***F42B 4/20*** | (2006.01) |
| ***F42B 4/14*** | (2006.01) |
| *F41A 19/58* | (2006.01) |
| *F42C 11/06* | (2006.01) |

(52) U.S. Cl.
CPC ..... *F42B 4/14* (2013.01); *F42B 4/20* (2013.01); *F42B 4/24* (2013.01); *F41A 19/58* (2013.01); *F42C 11/06* (2013.01)

(58) Field of Classification Search
CPC ..... F42B 4/00; F42B 4/06; F42B 4/14; F42B 4/20; F42B 4/24; F42C 11/06; F42C 13/04; F42C 13/045; F42C 13/047; F41A 19/58
USPC ..... 102/215, 217, 335, 345, 360
See application file for complete search history.

(56) References Cited

U.S. PATENT DOCUMENTS

| | | | | |
|---|---|---|---|---|
| 6,393,990 | B1 | 5/2002 | Fagan | |
| 6,561,102 | B1 | 5/2003 | Wang | |
| 6,912,958 | B2 | 7/2005 | Marietta | |
| 7,314,005 | B2 | 1/2008 | Deye | |
| 7,493,859 | B2 | 2/2009 | Russell | |
| 7,568,431 | B1 * | 8/2009 | Stria | F42B 4/18 102/202.14 |
| 7,597,047 | B2 * | 10/2009 | Doyle | F41A 33/04 102/355 |

(Continued)

FOREIGN PATENT DOCUMENTS

CN 204100295 U * 1/2015

OTHER PUBLICATIONS

Winco Fireworks, "Firefly Wireless Firing Module: Instruction Manual," available via URL https://cdn.shopify.com/s/files/1/1871/5099/t/3/assets/FireFly-Instruction-Manual.pdf?v=1; website copyright 2017.

(Continued)

*Primary Examiner* — James S Bergin
(74) *Attorney, Agent, or Firm* — Charlotte C. Wilson

(57) ABSTRACT

A consumer-ready, disposable pyrotechnic display system includes a pyrotechnic module and a control module. The pyrotechnic module includes a mounting substrate, electrically ignitable pyrotechnic devices, and electrical conductors connected to the pyrotechnic devices and disposed beneath the mounting substrate. The control module includes a housing having an upper surface and a bottom surface on which electrical contacts are disposed; and a processor, a memory, a power supply, and a transceiver within the housing. The electrical conductors are connected to the electrical contacts prior to receipt by the consumer. When the transceiver receives a signal from a remote device (such as a cellular telephone), the processor ignites each of the electrical conductors in a sequence programmed into the memory of the control module.

20 Claims, 15 Drawing Sheets

(56) References Cited

U.S. PATENT DOCUMENTS

| | | | | |
|---|---|---|---|---|
| 7,757,607 | B1 | 7/2010 | Deye | |
| 8,118,157 | B1 | 2/2012 | Piccolin | |
| 8,365,665 | B2 | 2/2013 | Risner et al. | |
| 8,479,651 | B2 * | 7/2013 | Schaeffer | F41A 33/04 102/200 |
| 8,516,963 | B2 | 8/2013 | Bossarte et al. | |
| 8,539,884 | B2 | 9/2013 | Deye | |
| 9,400,159 | B2 | 7/2016 | Bossarte et al. | |
| 2003/0070572 | A1 * | 4/2003 | Tang | F41A 19/65 102/349 |
| 2006/0060575 | A1 | 3/2006 | Lindsey et al. | |
| 2009/0145321 | A1 | 6/2009 | Russell | |
| 2012/0210897 | A1 | 8/2012 | Johnson | |
| 2014/0238259 | A1 | 8/2014 | Son | |
| 2018/0066927 | A1 | 3/2018 | Wu | |

OTHER PUBLICATIONS

Winco Fireworks, "How It Works," Internet article about FireFly wireless firing module, available via URL https://shootfirefly.com/pages/how-it-works; website copyright 2017.

Pyrics Ltd., "Pyrics Wireless Fireworks Launchers: User Guide," downloaded from URL https://cdn.shopify.com/s/files/1/0104/8142/files/Pyrics_Firework_Launcher_User_Guide_111009_6.pdf on Sep. 5, 2017.

Pyrics Ltd., "Pyrics Wireless Fireworks Launcher" brochure, downloaded from URL https://cdn.shopify.com/s/files/1/0104/8142/files/Pyrics_Fireworks_Launcher Brochure_111009_8.pdf on Sep. 5, 2017.

* cited by examiner

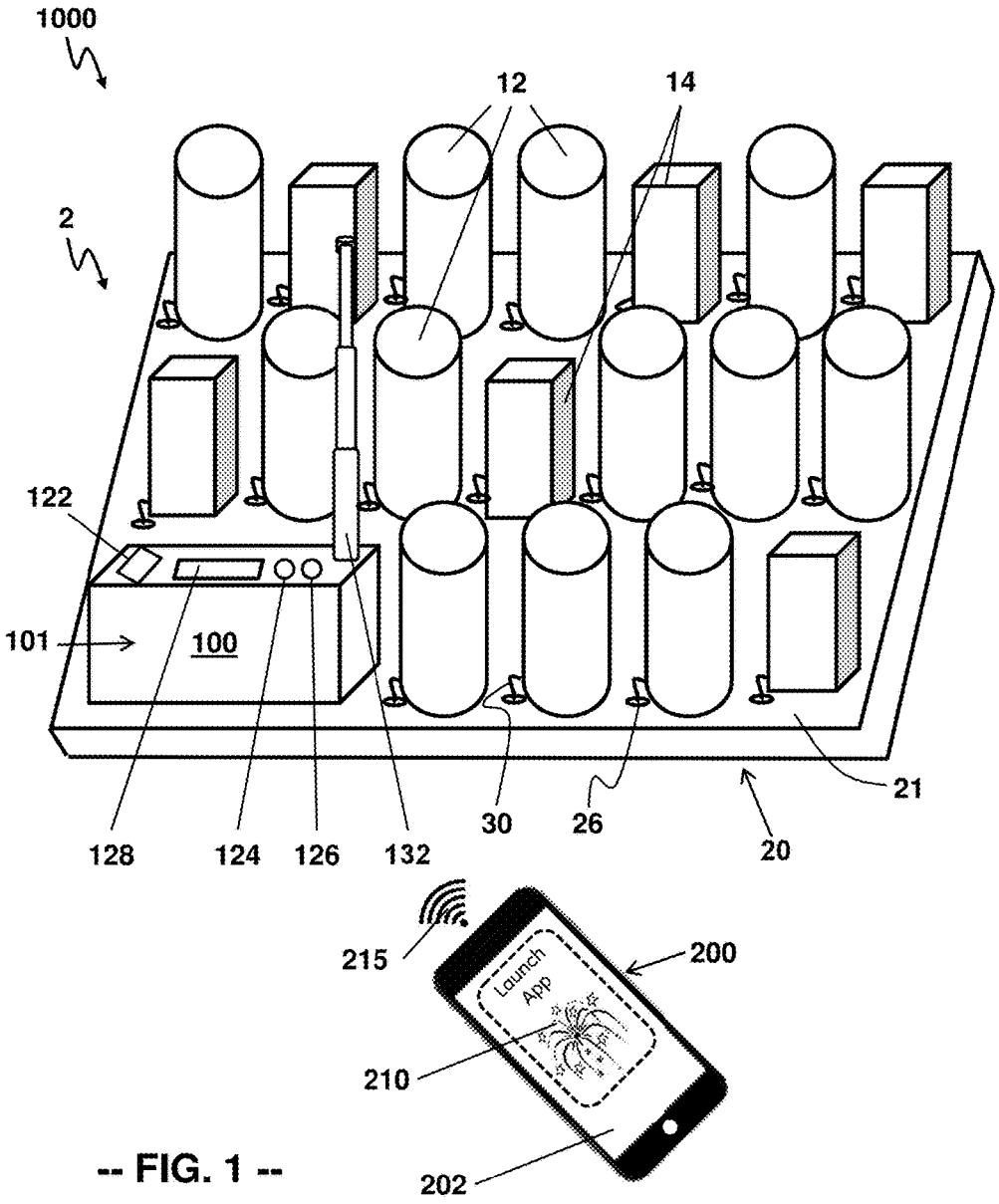
-- FIG. 1 --

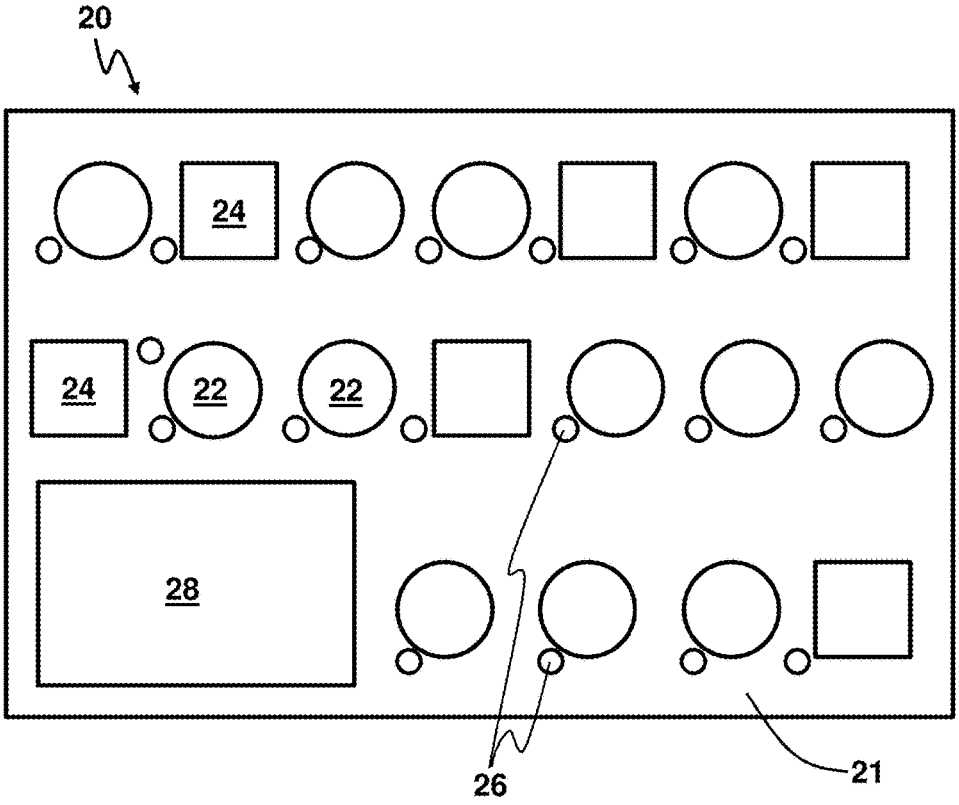
-- FIG. 2 --

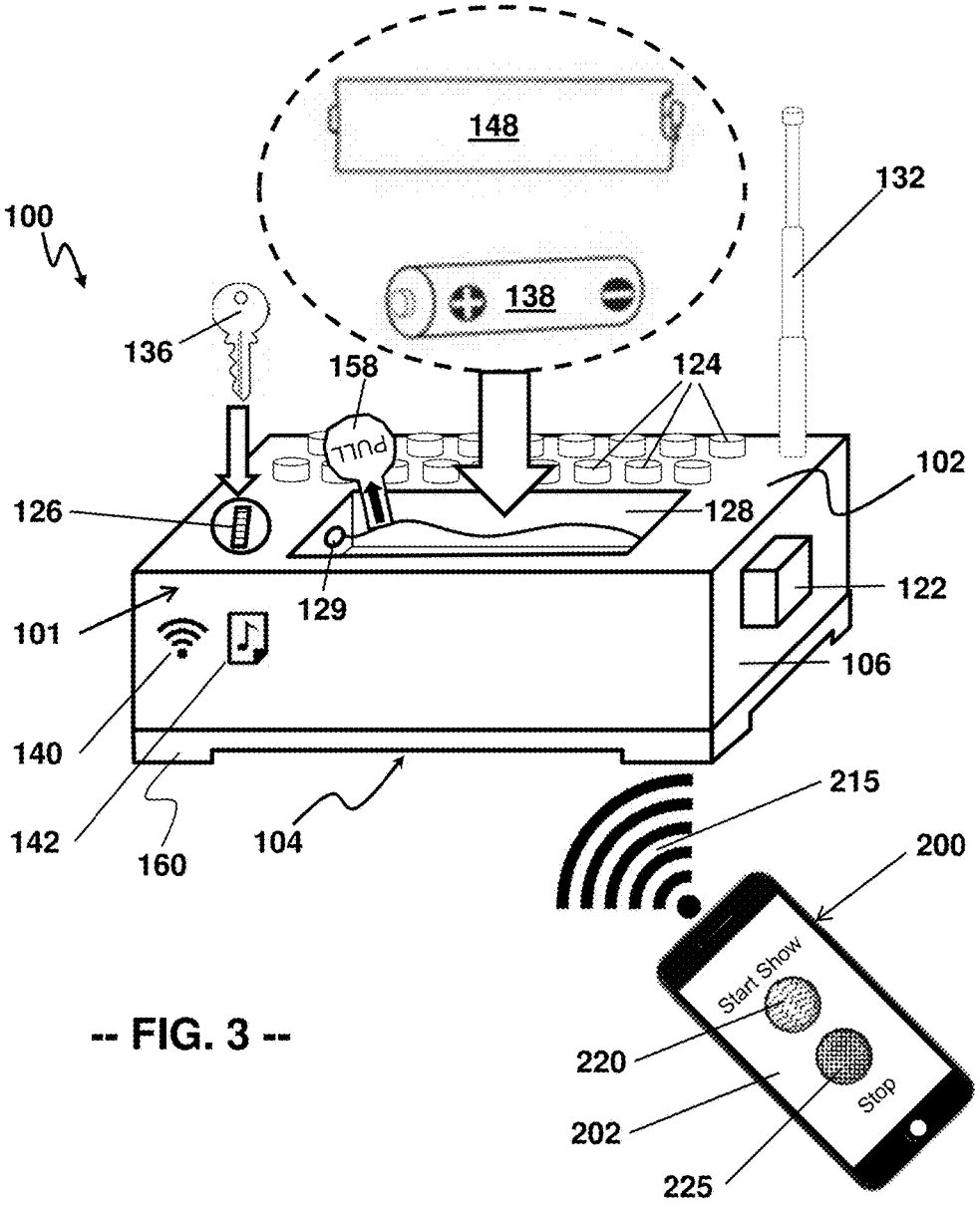
-- FIG. 3 --

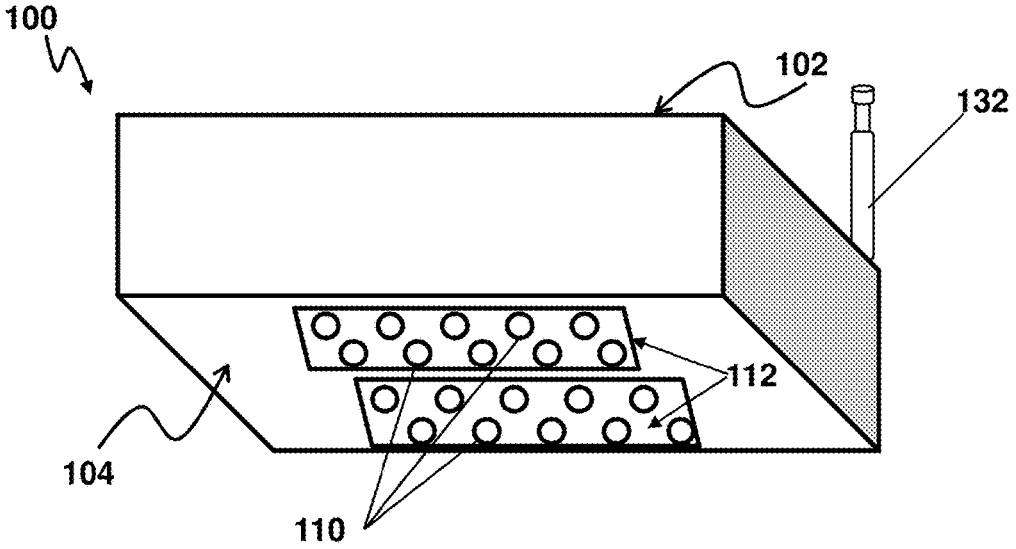
-- FIG. 4 --

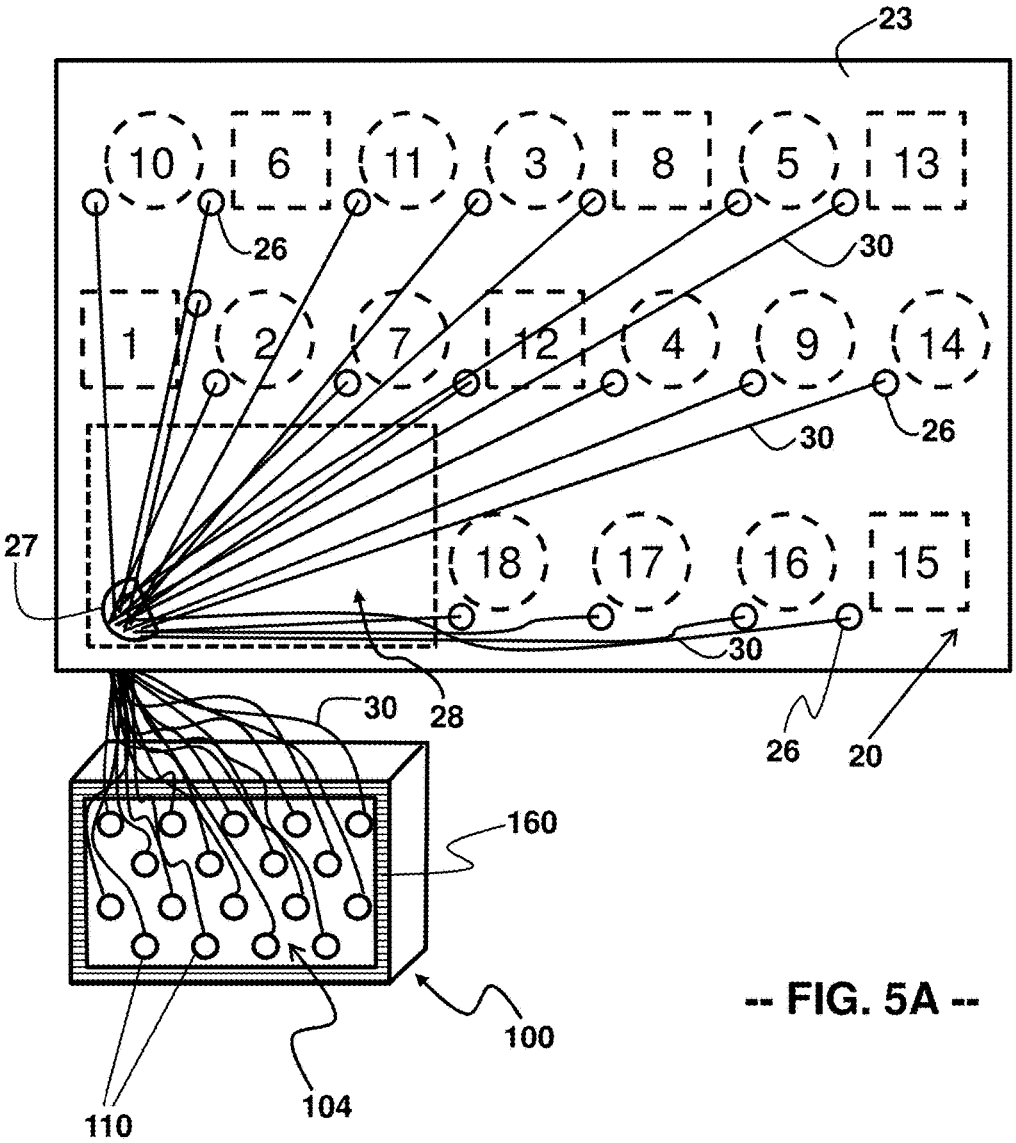
-- FIG. 5A --

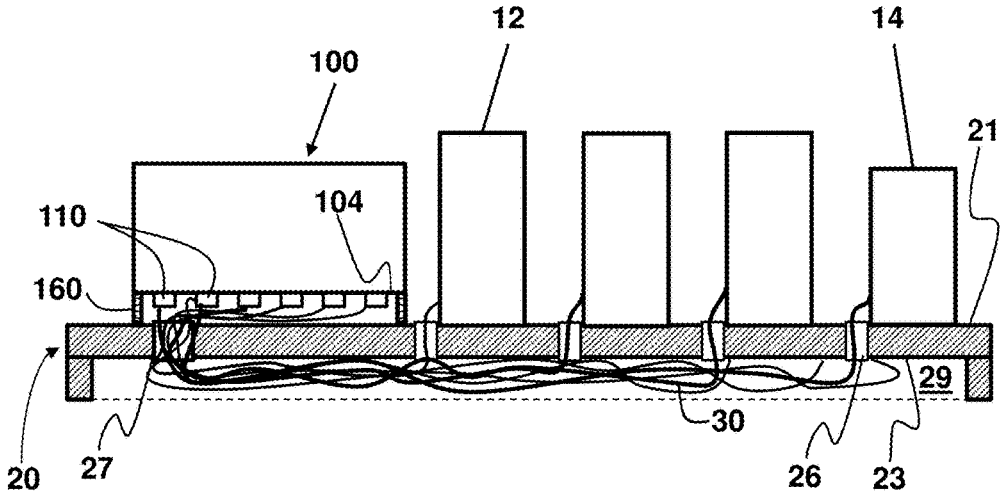
-- FIG. 5B --

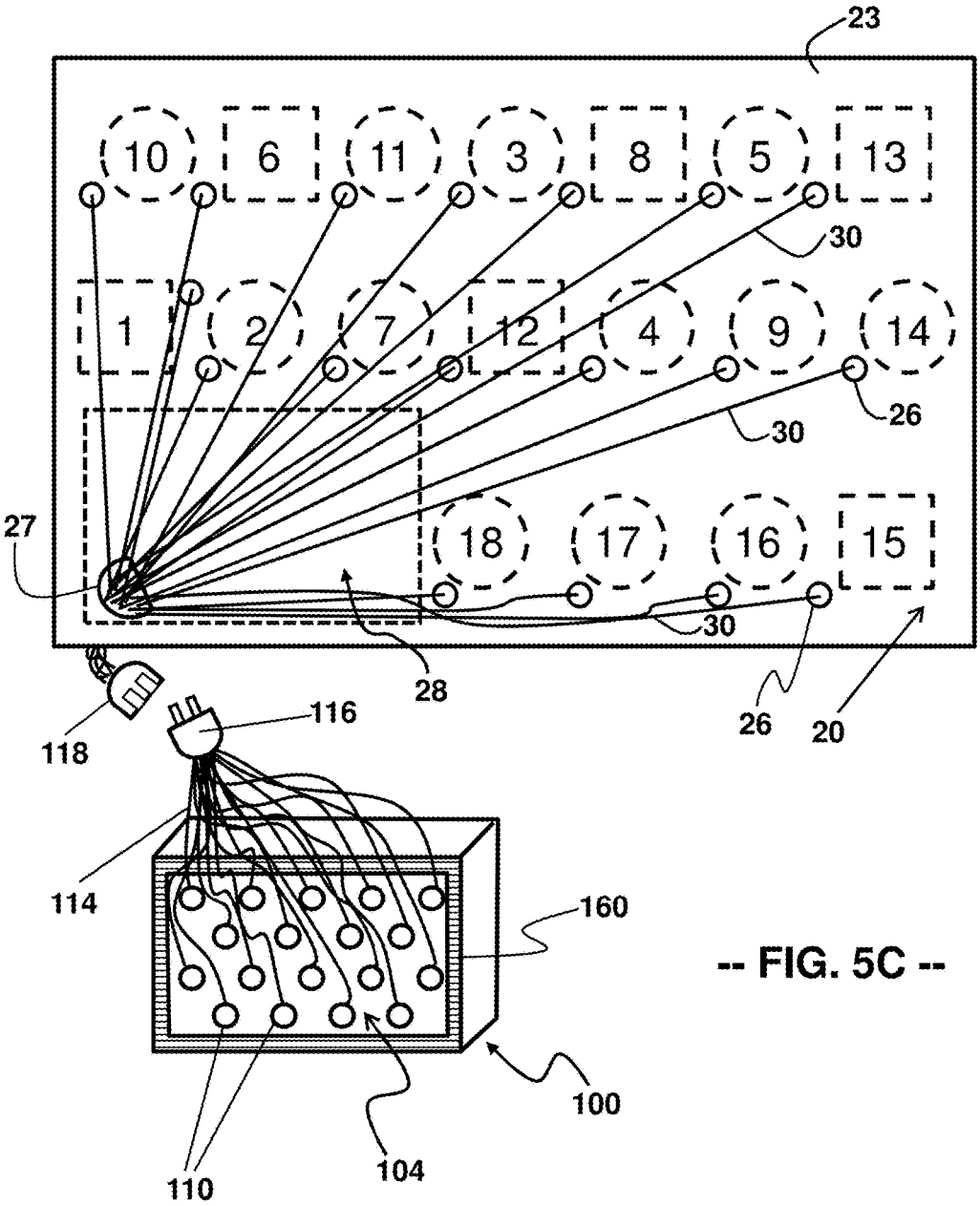
-- FIG. 5C --

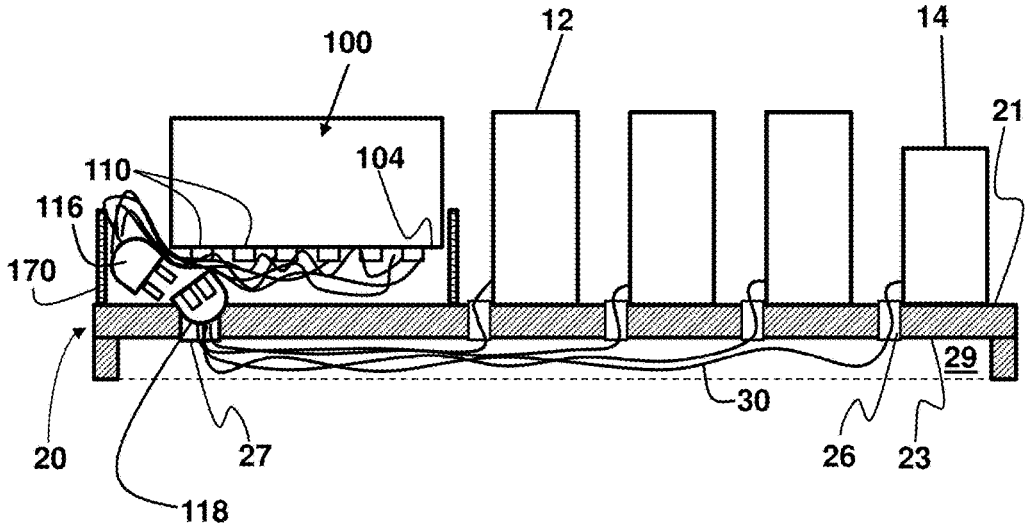
-- FIG. 5D --

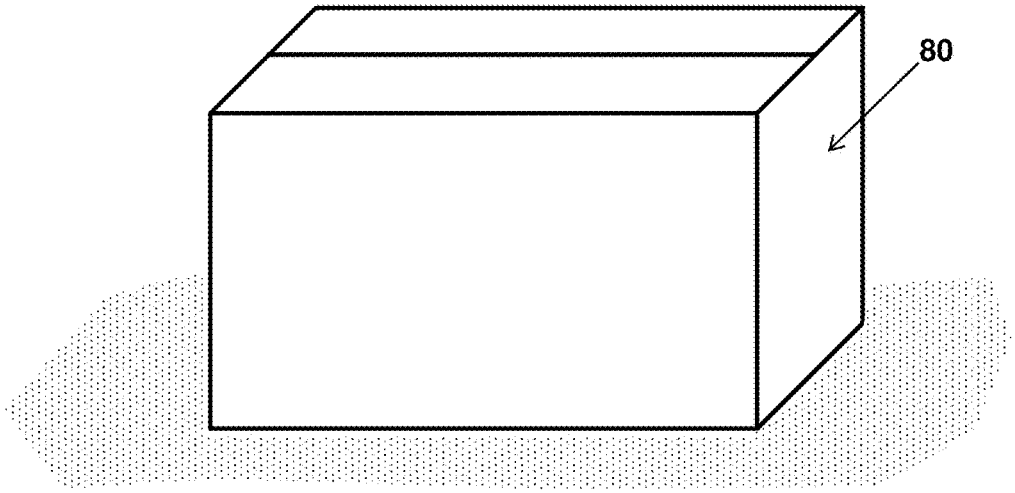
-- FIG. 6A --
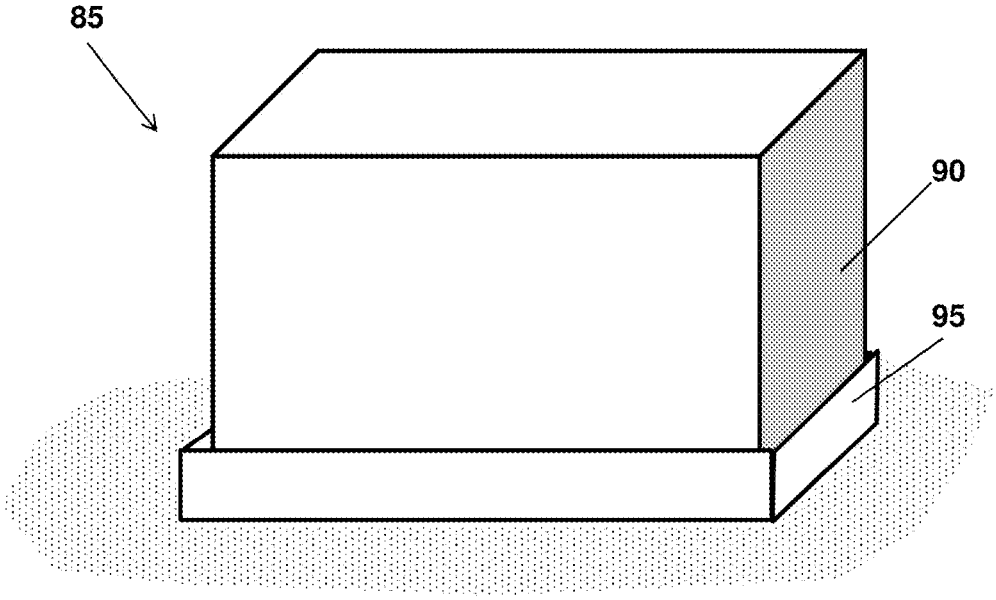
-- FIG. 6B --

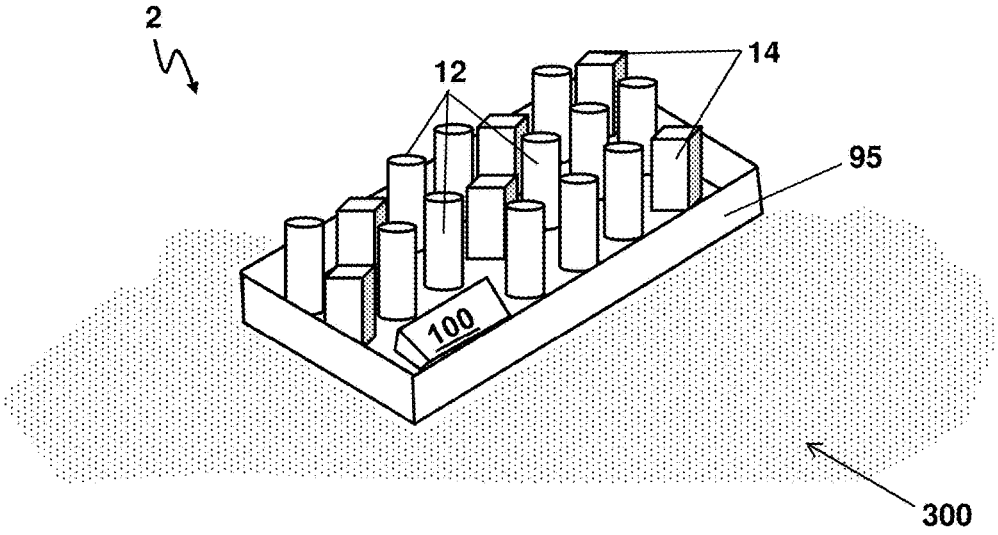
-- FIG. 7 --

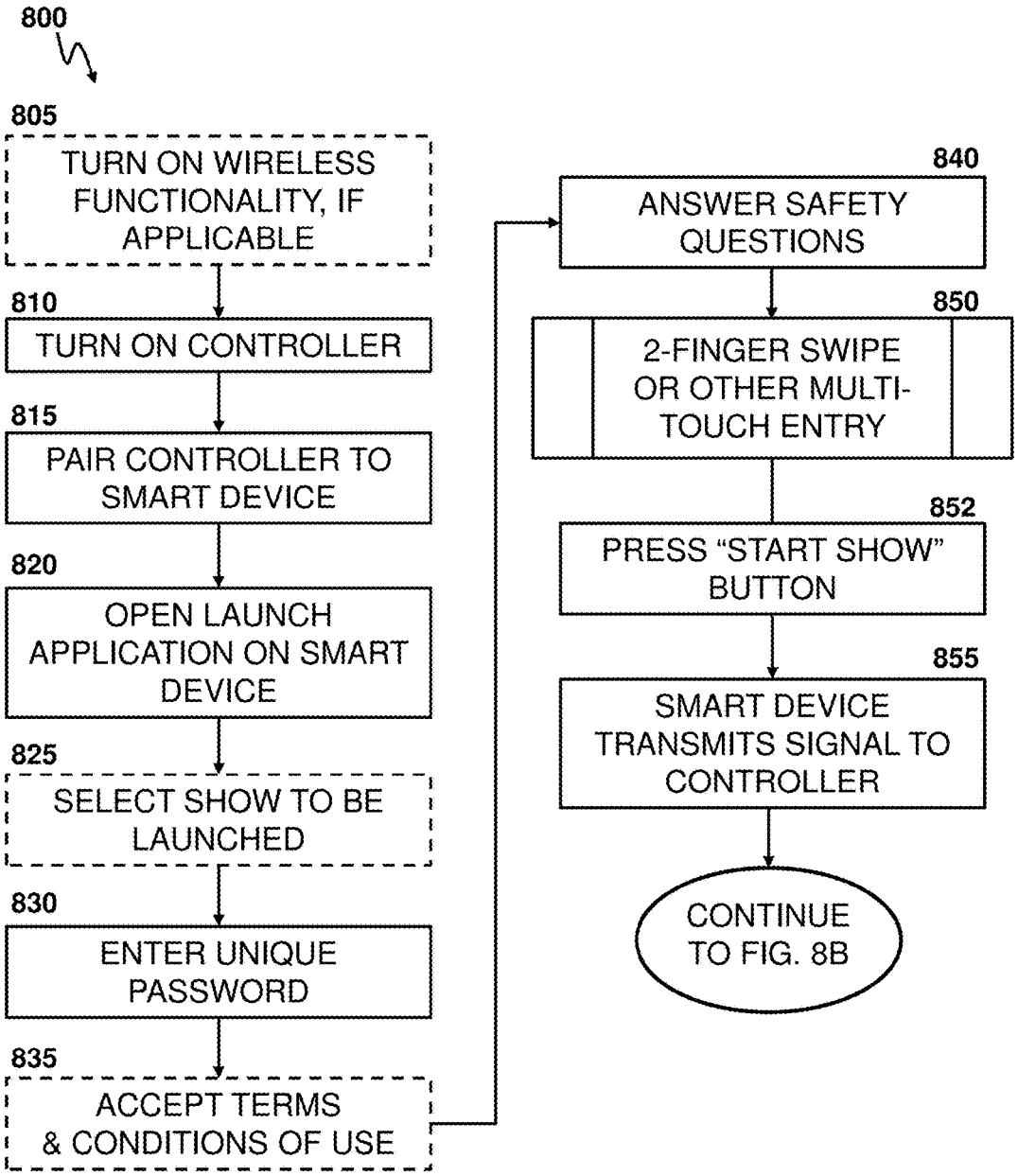
-- FIG. 8A --

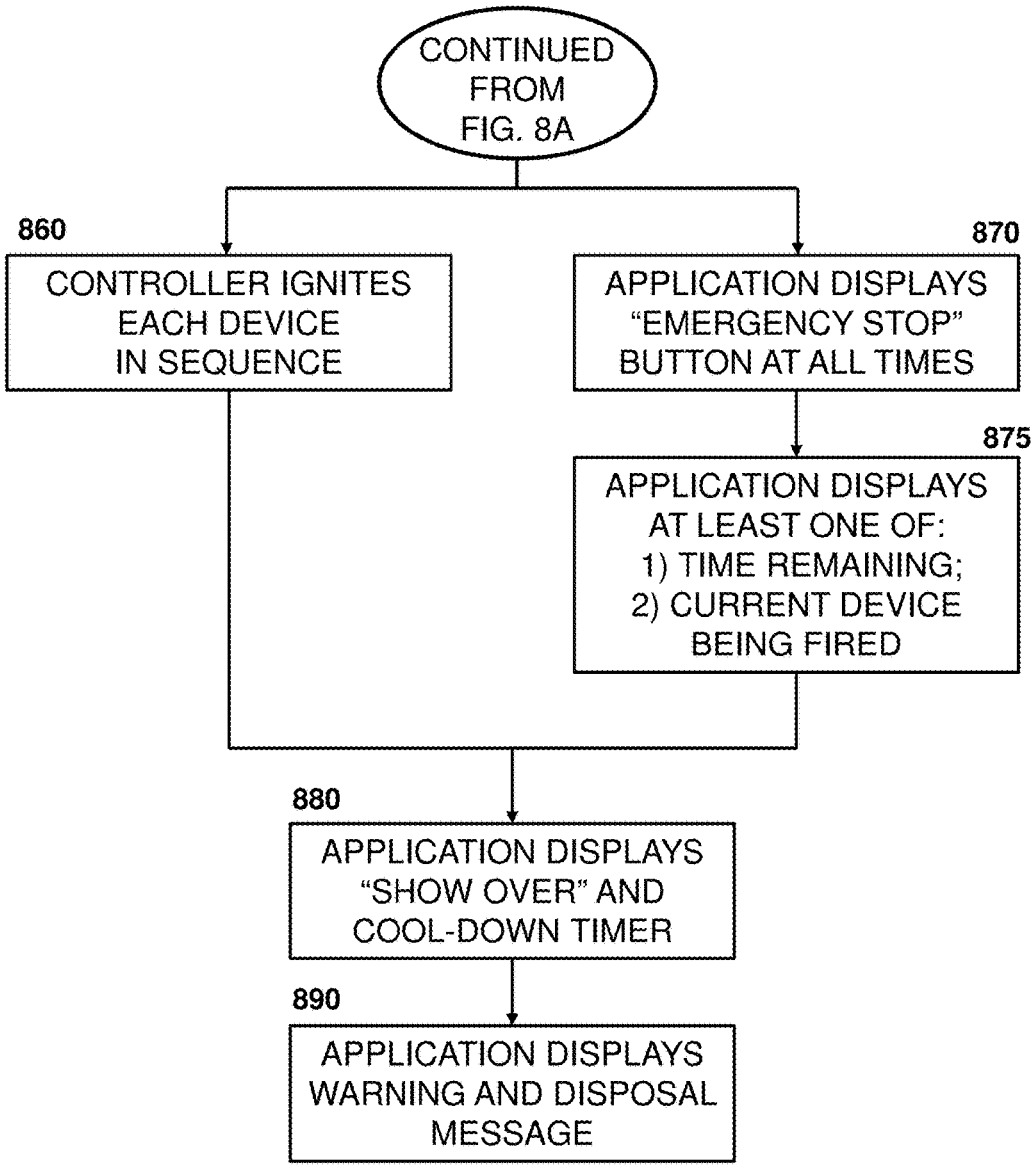
-- FIG. 8B --

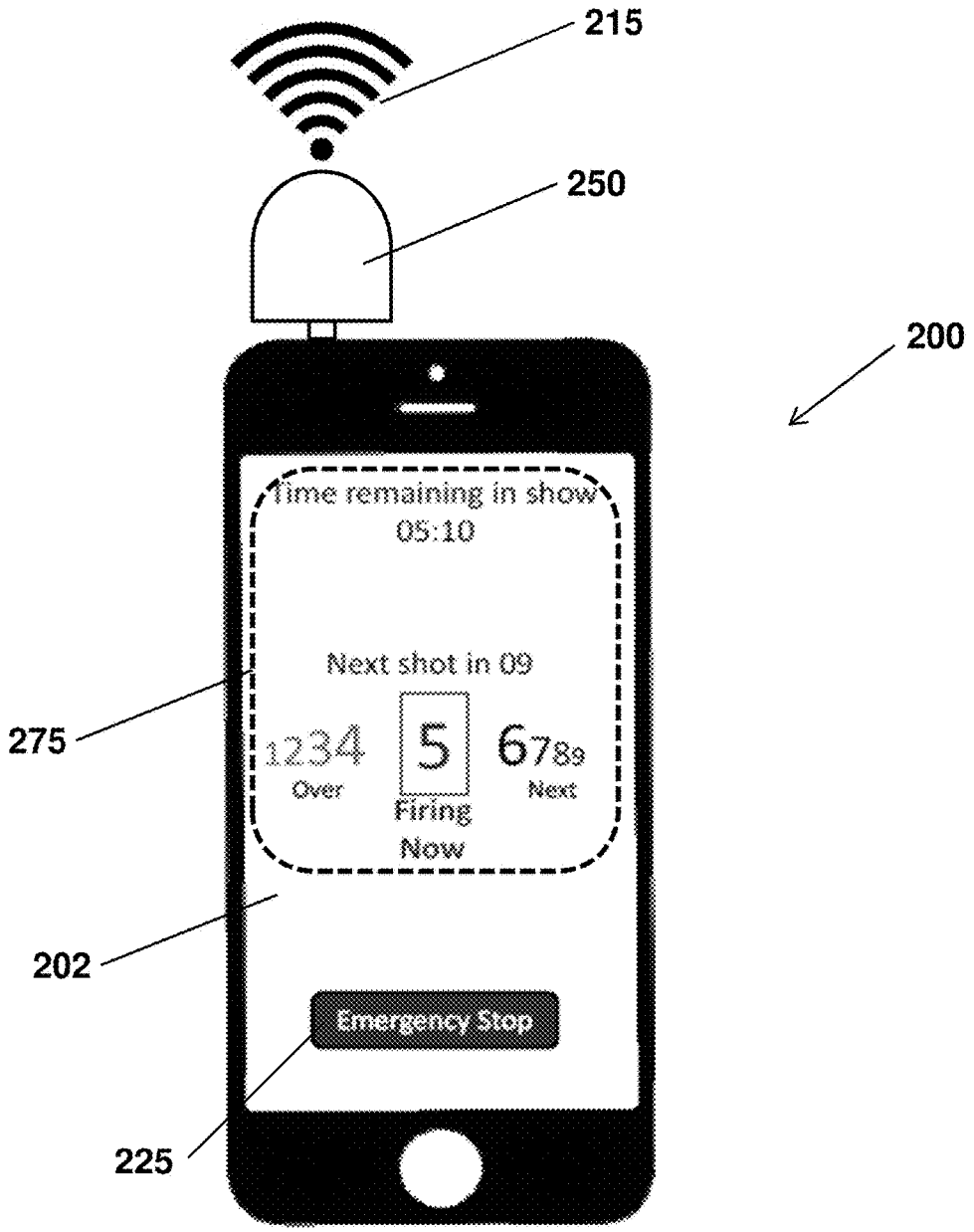
-- FIG. 9 --

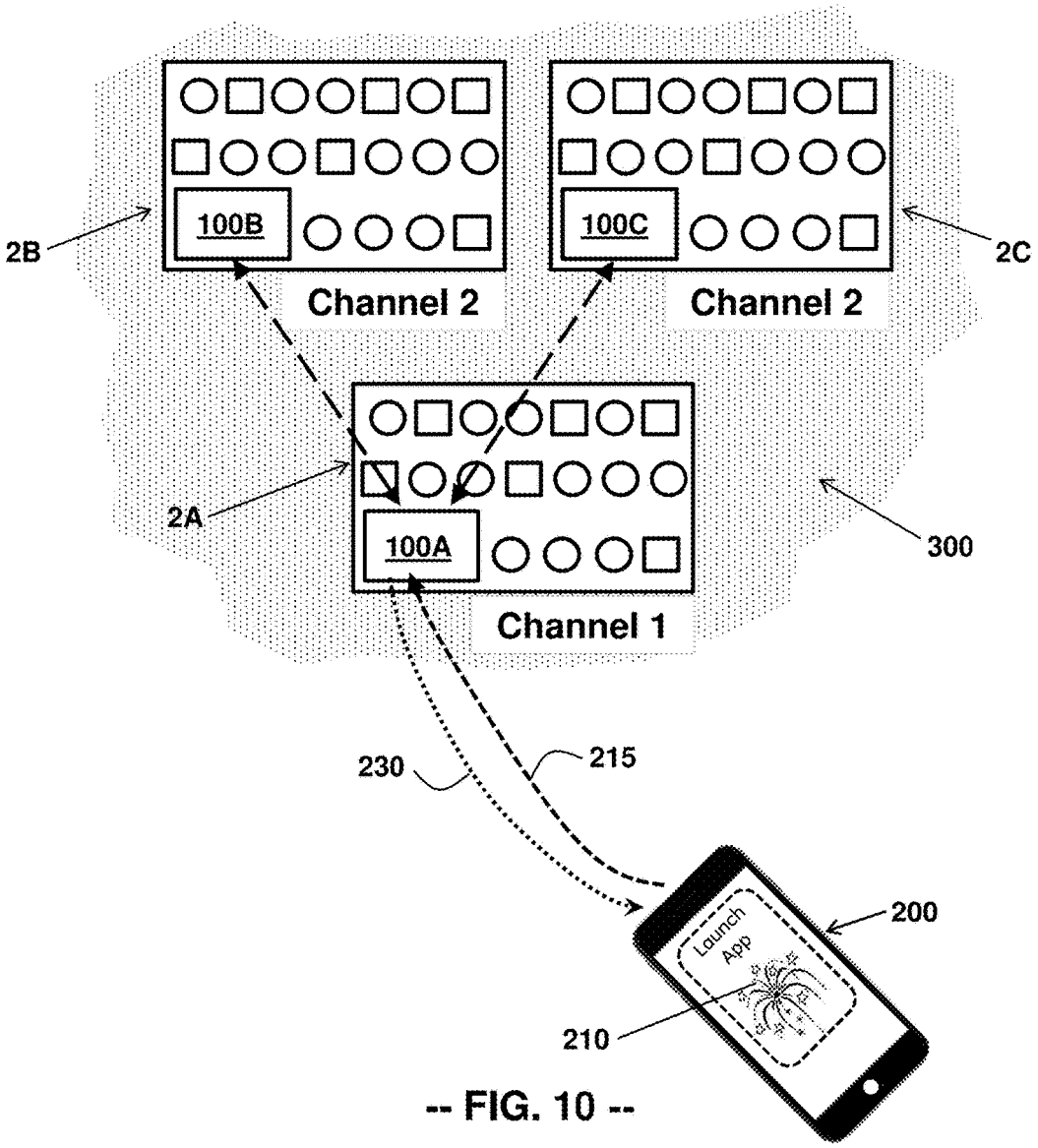
-- FIG. 10 --

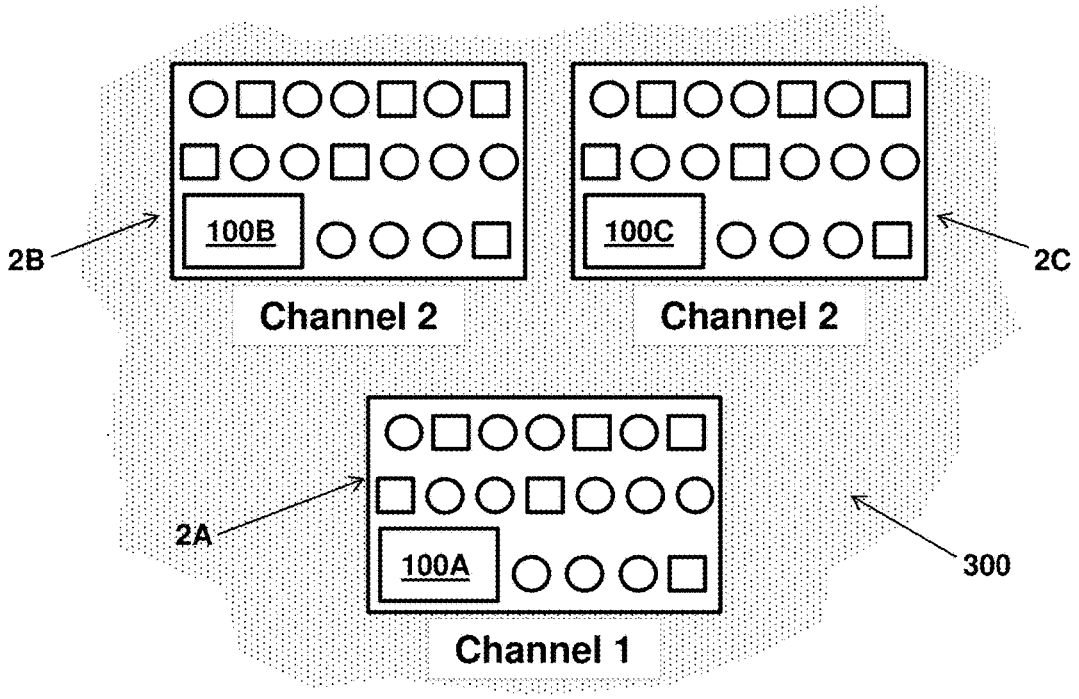
| Time | Channel | Device No. |
|---|---|---|
| 00:01 | 1 | 1 |
| 00:20 | 1 | 2 |
| 00:30 | 2 | 1 |
| 00:42 | 2 | 2 |
| 01:00 | 1 | 3 |
| ... | ... | ... |
120
-- FIG. 11 --

CONSUMER-READY PYROTECHNIC DISPLAY SYSTEM AND CONTROL MODULE THEREFOR

CROSS-REFERENCE TO RELATED APPLICATIONS

The present disclosure is a non-provisional application, which claims priority to U.S. Provisional Patent Application No. 62/395,330, filed Sep. 15, 2016, the entire disclosure of which is hereby incorporated by reference herein.

TECHNICAL FIELD

The present disclosure is related to pyrotechnic displays and, more specifically, to a consumer-ready pyrotechnic display system. The display system includes an array of pyrotechnic devices that are pre-wired to a control module that can be operated from a remote device, such as a cellular telephone. The control module is in electrical communication with the plurality of pyrotechnic devices. To ensure safe operation by a consumer of the pyrotechnic display system, the electrical contacts are positioned on a bottom surface of the control module housing out of sight by the consumer.

BACKGROUND

In professional fireworks displays, it is known that the person assembling the pyrotechnic devices for the display (the "pyrotechnician") may mount such devices to a mounting board or platform to facilitate their launch or may arrange such devices on the ground in the launch area. In some instances, the pyrotechnician may employ a controller that initiates the ignition of the pyrotechnic devices using electrical conductors, such as electrical matches ("e-matches"). Typically, such controller housings include a plurality of electrical contacts on an upper or side surface readily accessible to the pyrotechnician, so that the e-matches or fuses from the individual pyrotechnic devices are easily attached during set up in the field. In some instances, an electrical charge is transmitted to a heating coil, which requires significant input from a large power supply (such as eight D-cell batteries).

The controller is usually operated by a remote control specific for this purpose, which is wired directly to the controller or which communicates wirelessly to the controller from a safe operating distance. In many instances, the pyrotechnician presses a button for the ignition of the pyrotechnic devices, relying on his own understanding of the time that each pyrotechnic device lasts to determine when to initiate the next pyrotechnic device, or relying on an automated script embedded within the controller that has been programmed to initiate the next pyrotechnic device.

Clearly, while such sophisticated, computer-controlled firing systems are useful for professional pyrotechnicians, their significant cost and complexity are significant drawbacks to amateur fireworks enthusiasts and those consumers that use fireworks occasionally for entertainment or celebration of a special occasion.

The occasional fireworks consumer and the amateur fireworks enthusiast may perceive several impediments to their enjoyment of self-run pyrotechnic displays. First, the consumer may be concerned with the safety of setting up and igniting multiple pyrotechnic devices. The consumer may be unfamiliar with safe practices for arranging pyrotechnic devices relative to one another and for igniting the pyrotechnic devices in an efficient manner without sustaining an injury or causing property damage.

Additionally, the more casual consumer may feel uncomfortable selecting an array of pyrotechnic devices necessary to produce a high quality pyrotechnic display. With the large number of pyrotechnic devices available to consumers in stores, in catalogs, and on websites, the individual consumer trying to design a cohesive and aesthetically pleasing show may easily feel overwhelmed.

Finally, while professional pyrotechnicians are experienced with wiring pyrotechnic devices to a central control module for ignition, many consumers may feel uncertain about their ability to successfully wire the devices to a firing system—even if the consumers are able to afford it. For most consumers, it is economically infeasible to purchase a sophisticated computer-controlled firing system and remote device for igniting a pyrotechnic display, which may cost hundreds or even thousands of dollars, especially if they intend only to produce a single pyrotechnic display for a special occasion.

It would be useful, therefore, to provide a consumer-ready pyrotechnic display system having a pyrotechnic module in which the pyrotechnic devices are pre-selected, secured in an orientation ready for ignition, and, ideally, pre-wired to a control module. It would further be useful for the control module to include a memory storing an internal script executable by a processor within the control module, such that the consumer or a technician does not have to select and engage the devices himself. Moreover, it would be useful for the electrical contacts and e-matches to be hidden or located on the bottom of the control module housing and mounting surface, respectively, to reduce the likelihood of the e-matches becoming dislodged and to discourage tampering by an inexperienced consumer.

In another aspect, it would be useful to provide a pyrotechnic display system in which the pyrotechnic module includes a set of pre-selected pyrotechnic devices that are secured to a mounting surface and pre-wired into a common plug, which the consumer or pyrotechnician may engage with a corresponding plug from the control module. Such a system would provide a safe means of forming the electrical connection between the control module and the pyrotechnic devices, using plugs that are familiar to most consumers and thereby eliminating the need for the consumer to wire the pyrotechnic devices to the control module himself.

Additionally, it would be useful to provide an application for a cellular telephone or other ubiquitous "smart" device to communicate with the control module to initiate the launch of the pyrotechnic devices into a professional-looking display, thus eliminating the need for a special, single-purpose remote.

The present disclosure addresses these needs.

SUMMARY

A consumer-ready, disposable pyrotechnic display system includes a pyrotechnic module and a control module. The pyrotechnic module includes a mounting substrate, electrically ignitable pyrotechnic devices, and electrical conductors connected to the pyrotechnic devices and disposed beneath the mounting substrate. The control module, which is attached to the mounting substrate, includes a housing having an upper surface and a bottom surface on which electrical contacts are disposed; and a processor, a memory, a power supply, and a transceiver within the housing. Electrical contacts are disposed solely on the bottom surface of the housing inaccessible by a consumer of the pyrotechnic display system. The electrical conductors are connected to the electrical contacts prior to receipt by the consumer. When the transceiver receives a signal from a remote device, the processor ignites each of the electrical conductors in a sequence programmed into the memory of the control module.

The remote device may be a handheld device (such as a cellular telephone or tablet computer) or a wearable device (such as a smart watch or a computer peripheral device in the form of eyeglasses).

BRIEF DESCRIPTION OF THE DRAWINGS

A full and enabling disclosure of the present products and methods, including the best mode thereof, directed to one of ordinary skill in the art, is set forth in the specification, which makes reference to the appended figures, in which:

FIG. 1 is a perspective view of the present pyrotechnic display system having a pyrotechnic module and a control module;

FIG. 2 is a plan view of a mounting board to which the control module and a plurality of pyrotechnic devices of the pyrotechnic module of FIG. 1 may be mounted;

FIG. 3 is a perspective view of the control module of the present disclosure and a remote device (e.g., a cellular telephone) used for communication with the control module, according to various aspects of the present disclosure;

FIG. 4 is a perspective view of a bottom surface of the control module, as in FIGS. 1 and 3;

FIG. 5A is a schematic view of a bottom surface of the mounting board of FIG. 2 and a bottom surface of the control module of FIGS. 3 and 4, which illustrates the electrical conductors disposed between each of plurality of pyrotechnic devices and the control module;

FIG. 5B is a schematic cross-sectional view of the pyrotechnic display system of FIG. 5A;

FIG. 5C is a schematic view of an alternate configuration of electrical conductors extending from each of the plurality of pyrotechnic devices to a plug, the plug connecting to a corresponding socket of the control module;

FIG. 5D is a schematic cross-sectional view of an alternate configuration of the pyrotechnic display system, in which the electrical conductors extend from each of the pyrotechnic devices to a plug, the plug connecting to a corresponding socket of the control module and the control module being disposed within a control module frame;

FIG. 6A is a perspective view of a carton useful for containing the present pyrotechnic display system;

FIG. 6B is a perspective view of a box having a lid, which may be useful for containing the present pyrotechnic display system;

FIG. 7 is a perspective view of the pyrotechnic display system of the present disclosure, as ready for launching;

FIGS. 8A and 8B illustrate a flow chart of the operation of the present pyrotechnic ignition system;

FIG. 9 is a plan view of a remote device (e.g., a cellular telephone), optionally including a signal-boosting dongle, according to another aspect of the present disclosure; and FIG. 10 is a plan view of three exemplary pyrotechnic display systems, as arranged in a discharge area, illustrating wireless communication between the respective control modules and a smart device;

FIG. 11 is a plan view of three exemplary pyrotechnic display systems, as arranged in a discharge area, along with a portion of an exemplary firing script.

DETAILED DESCRIPTION

Reference will now be made in detail to embodiments of the inventive products and methods, one or more examples of which are illustrated in the drawings. The detailed description uses numerical and letter designations to refer to features in the drawings. Like or similar designations in the drawings and description have been used to refer to like or similar parts of the invention. As used herein, the terms "first," "second," and "third" are used to signify the relative location of the individual components.

As used herein, the terms "connect", "connected", "connecting", "couple", "coupled", "couples", "coupling", and the like should be broadly understood as referring to the connection between two or more elements or signals, whether electronically, mechanically, or otherwise. Two or more electrical components may be electrically coupled or connected, but may not be mechanically or otherwise coupled or connected. Two or more mechanical components may be mechanically coupled or connected, but may not be electrically or otherwise coupled or connected. Two or more electrical elements may be mechanically coupled or connected, but may not be electrically or otherwise coupled or connected. Coupling or connecting may be for any length of time, including permanent, semi-permanent, or momentary.

Each example is provided by way of explanation of the invention, not limitation of the invention. In fact, it will be apparent to one of ordinary skill in the art that various modifications and variations can be made in the present invention without departing from the scope or spirit of the invention. For instance, features illustrated or described as part of one embodiment can be used with another embodiment to yield a still further embodiment. Thus, it is intended that the present disclosure covers such modifications and variations as fall within the scope of the appended claims and their equivalents.

FIG. 1 illustrates a pyrotechnic ignition system 1000, including a pyrotechnic module 2, a control module 100, and a consumer device 200 (such as a cellular telephone) that communicates with the control module 100. The pyrotechnic module 2 includes a mounting board 20, or a mounting substrate, on which a plurality of pyrotechnic devices 12, 14 are mounted. In one embodiment, the control module 100 is permanently mounted to the mounting board 20, such that the control module 100 cannot be moved, dislodged, disconnected, or disrupted. In an alternate embodiment, the control module 100 may be removably mounted to the mounting board 20.

The pyrotechnic devices 12, 14 are preferably of the 1.4G type used in consumer fireworks displays, which are intended for use by the general public. It should be noted that, although only two different types of pyrotechnic devices 12, 14 are illustrated in the Figures, any type or number of different pyrotechnic devices may be used. Examples of types of pyrotechnic devices 12, 14 include, but are not limited to, bouquets, cakes, comets, fountains, gerbs, girandolas, mines, Roman candles, and the like.

Moreover, although eighteen pyrotechnic devices 12, 14 are shown for exemplary purposes, it should be understood that any number of pyrotechnic devices 12, 14 may be mounted to the mounting board 20. For example, the pyrotechnic module 2 may have between 8 and 36 individual pyrotechnic devices 12, 14, including eight, ten, twelve, fourteen, sixteen, eighteen, twenty, twenty-four, twenty-eight, thirty, thirty-two, and thirty-six pyrotechnic devices 12, 14, or any other suitable number. One typical configuration is contemplated to include either twenty or twenty-four pyrotechnic devices 12, 14.

The control module 100 includes a housing 101 having an upper surface 102 (shown more clearly in FIG. 3), and the upper surface 102 may include a power (on/off) switch 122, at least one light 124, an optional key ignition slot 126, and/or a battery compartment 128. In one embodiment, the control module 100 may include a telescoping antenna 132. The at least one light 124 indicates the status of the electrical connections between the control module 100 and the individual pyrotechnic devices 12, 14. The at least one light 124 may be an LED light, as described further below.

The components of the control module 100 may include devices such as chips, boards, integrated circuits, processors, memory, GPUs, CPUs, microcontrollers, or any combination of these devices. One particular example of a processor for the control module 100 is commercially available from ARDUINO® under the name "MEGA 2560."

The control module 100 includes a processor within the housing 101, which may be electrically connected to any or all of the components within or on the housing 101. In a preferred embodiment, the processor is coupled to all of the components in, or on, the housing 101. In an alternate embodiment, the processor is coupled to most of the components in, or on, the housing 101. In yet another embodiment, the processor may employ software to control the functions of components within, or on, the housing 101 without the need for physical connections.

The components of the control module 100 may be configured in any suitable manner to interface with, or manage, the operation of coupled devices to perform a number of specialized functions. Transmitters, receivers, Subscriber Identification Module (SIM) cards, and other electronic components may optionally be incorporated into the housing 101, in addition to or instead of any of the components described herein.

The control module 100 includes a memory device or component (not shown separately). For example, the memory device may be a Secure Digital (SD) memory card or other flash memory. The memory device may be of the read-only type. In some instances, it may be desirable to include multiple memory devices, one of which is read-only and one of which is write-only. The memory may include a script (120, shown in FIG. 11) for executing the ignition of the pyrotechnic devices 12, 14.

The light(s) 124 may be electrically connected to any or all of the components within the housing 101, and, particularly, may be connected to both the power supply 138 (shown in FIG. 3 and housed in the battery compartment 128) and the control module 100. Each of the light(s) 124 may be a light-emitting diode (LED). The light(s) 124 may also flicker, flash, or strobe features, if desired.

In at least one embodiment, the light(s) 124 may be capable of displaying multiple colors, each of which may be indicative of an associated condition. For example, the light 124 may display a green color when the device is functioning properly, while the light 124 may display an orange color when the processor recognizes a faulty connection between one of the electrical contacts 110 and a respective one of the pyrotechnic devices 12, 14. Alternately, the control module 100 may include more than one light 124 (as shown in FIG. 3), and the multiple lights 124 may be a single color or may be different colors.

The control module 100 further includes a wireless transceiver 140 (shown in FIG. 3), which is located within the housing 101 and which is electrically connected to any or all of the components within, or on, the housing 101. The transceiver 140 is connected to the processor by any operable means known in the art. The wireless transceiver 140 is any electronic device capable of receiving and transmitting wireless data, particularly over a short distance range. The wireless transceiver 140 may include individual components, such as a receiver and a transmitter.

The wireless transceiver 140 may comprise any device for sending and/or receiving wireless data, where the signal is compatible with the communication protocol standards for (a) wireless local area networks (WLANs, such as Wi-Fi) and/or (b) wireless personal area networks (WPANs, such as wireless USB, BLUETOOTH®, X-BEE®, ZIGBEE®) and/or (c) any other wireless protocol, such as IEEE 802.11 or its subsequent versions. It is beneficial to use transceivers that have relatively low energy requirements to minimize the size of the power supply and/or the number of batteries.

The consumer downloads an application 210 to his "smart device" to allow the smart device to function as a remote control for the control module 100. The "smart device" may be a hand-held device (such as a cellular telephone 200 or a tablet computer) or a wearable device (such as a smart watch or an optical head-mounted display designed in the shape of a pair of eyeglasses, including GOOGLE GLASS® wearable computer peripheral devices). The smart device transmits one or more signals 215 to the wireless transceiver 140, which receives the signal(s) 215.

It is contemplated that the application 210 is compatible with various operating systems of a wide variety of smart devices, including those with iOS® (Apple) and ANDROID® operating systems. For convenience, the smart device will be referred to herein as a cellular telephone, although it should be understood not to be limited to one particular type of smart device. As shown, the application 210 is downloaded onto the cellular telephone 200 and appears on a touch screen 202 of the cellular telephone 200. The application 210 is discussed in more detail below.

FIG. 2 illustrates the mounting board 20 to which the pyrotechnic devices 12, 14 are mounted. Each pyrotechnic device 12, 14 is secured to one of a plurality of attachment locations 22, 24 on an upper surface 21 of the mounting board 20, representations of the attachment locations 22, 24 being shown in FIG. 2. If desired, the upper surface 21 of the mounting board 20 may be printed or marked with the plurality of attachment locations 22, 24 sized and shaped and in a corresponding number to indicate where the pyrotechnic devices 12, 14, respectively, are attached. Adjacent to each attachment location 22, 24 for each pyrotechnic device 12, 14 is a conductor aperture 26 through which the electrical conductor 30 is fed, so that the electrical conductor 30 is hidden from view of the consumer and inaccessible to the consumer.

The mounting board 20 further includes an attachment area 28 to which the control module 100 may be secured. In one embodiment, the control module 100 is permanently mounted to the mounting board 20, e.g., using adhesives or fasteners. In another embodiment, the control module 100 may be removable, or separate, from the mounting board 20.

FIG. 3 illustrates an alternate configuration of the control module 100, in which the upper surface 102 of the control module 100 is provided with multiple lights 124 and in which the power (on/off) switch 122 is located on a side surface 106 of the housing 101. The power switch 122 may alternately be located on any other surface of the housing 101, as is convenient for the consumer.

In the exemplary configuration shown in FIG. 3, a light 124 may be associated with a respective pyrotechnic device 12 or 14, and each light 124 may be illuminated to confirm the positive electrical connection between a respective pyrotechnic device 12 or 14 and the control module 100. Alternately, as described above, the light 124 may be illuminated in a different color to indicate a faulty connection.

Further, in this configuration, the upper surface 102 includes the battery compartment 128 having terminals 129 complementary to the battery type and size. At least one dry-cell battery 138 is installed in the battery compartment 128, which is concealed by a battery compartment cover 148. To avoid the possibility of static electricity passing through the pyrotechnic display system 2 during transport, a removable tab 158 is positioned between the terminals 129 in the battery compartment 128. The tab 158 is removed by the consumer prior to insertion of the battery 138. To further ensure safety during transportation, the battery or batteries 138 may be shrink-wrapped and taped to the upper surface 102 of the control module 100, or placed elsewhere in the packaging box.

The battery 138 may be any appropriately sized battery, such as a AAA-cell battery, a AA-cell battery, a C-cell battery, a D-cell battery, and a 9-volt battery, and more than one battery 138 may be employed. In at least one embodiment, it has been found that AA-cell batteries provide sufficient energy to operate the control module 100. In one embodiment, four AA-cell batteries may be used. In another embodiment, six AA-cell batteries may be used. The battery 138 may be rechargeable, in those embodiments in which the control module 100 is configured for multiple uses.

In addition to the power (on/off) switch 122, the control module 100 may be provided with a secondary arming device in the form of a key 136, which is inserted by the consumer in the ignition key slot 126. The use of a secondary arming device affords additional security in the transport and use of the present pyrotechnic module 2 and pyrotechnic display system 1000.

Optionally, the memory of the control module 100 may be provided with an audio file 142, which may be used to provide musical accompaniment for the pyrotechnic display. The transceiver 140 in the control module 100 may transmit the audio file 142, via wireless transmission, to remote audio speakers (not shown) directly or via the cellular telephone 200. For example, the application installed on the cellular telephone 200 may retrieve the audio file 142, and the consumer may transmit the audio file 142 to remote audio speakers. Alternately, the consumer may transmit an audio file from his cellular telephone 200 to remote audio speakers for playing in conjunction with the pyrotechnic display.

As shown in FIG. 3, the cellular telephone 200 has an application 210 (shown in FIG. 1) that communicates the wireless signal 215 to the transceiver 140 in the control module 100. At the initiation of the pyrotechnic display, the screen 202 of the cellular telephone 200 displays at least a start button 220 and, optionally, a stop button 225. The displays on the screen 202 of the cellular telephone 200 during activation and operation of the pyrotechnic display system are discussed further herein.

The bottom surface 104 of the control module 100 is shown in FIG. 4. The bottom surface 104 of the control module 100 contacts the recess 28 (shown in FIG. 2), when the control module 100 is installed in the mounting board 20. The bottom surface 104 includes a plurality of electrical contacts 110 at least equal in number to the number of pyrotechnic devices 12, 14. In one embodiment, the electrical contacts 110 may be arranged in one or more terminal strips 112, as shown.

In one embodiment, the electrical contacts 110 are pre-assembled in electrical contact with the e-matches 30 connected to each pyrotechnic device 12, 14. By disposing the electrical contacts 110 on the bottom surface 104 of the control module 100, the likelihood of the electrical connection being disrupted is reduced, and the comfort of the consumer using the system 1000 is increased.

FIG. 5A illustrates schematically the electrical pathways between the control module 100 and the individual pyrotechnic devices 12, 14. The electrical contacts 110 on the bottom surface 104 of the control module 100 are connected to the pyrotechnic devices 12, 14 by respective electrical conductors 30, such as e-matches or fuses. The electrical conductors 30 may be directed through conductor apertures 26 in the mounting board 20 proximate to the pyrotechnic devices 12, 14, and may extend across the bottom surface 23 of the mounting board 20, before being directed through one or more feed apertures 27 in the mounting board 20 proximate to or within the recess 28 to connect to the electrical contacts 110 of the control module 100.

FIG. 5B illustrates a cross-sectional view of the pyrotechnic display system 1000, which shows the control module 100 and several pyrotechnic devices 12, 14. The electrical conductor 30 from each pyrotechnic device 12, 14 extends through a respective conductor aperture 26 adjacent the pyrotechnic device 12, 14 and is fed through a cavity 29 beneath the bottom surface 23 of the mounting board 20, or substrate. The electrical conductors 30 are gathered into a bundle and threaded through the feed aperture 27 for connection to the electrical contacts 110 on the bottom surface 104 of the control module 100. The bottom surface 104 of the control module 100 may include a frame 160 around at least a portion of the perimeter thereof to provide space for the electrical conductors 30 to connect to the electrical contacts 110.

In an alternate embodiment shown in FIG. 5C, the electrical contacts 110 may be provided with a plurality of wires 114 extending therefrom, and the plurality of wires 114 may be aggregated into a male plug 116. The electrical conductors 30 extending from the pyrotechnic devices 12, 14 may be fed through apertures 26 in the mounting board 20 and may extend along the bottom surface 23 toward the feed aperture 27. At or near the feed aperture 27, the electrical conductors 30 may similarly be aggregated into a female plug 118 configured to mate with the male plug 116. The plugs 116, 118 may be provided with internal pins, such as may be part of a ribbon strip, to associate the wires 114 with the respective electrical conductors 30.

FIG. 5D illustrates another variation of the pyrotechnic display system 1000 shown in FIG. 5C, in which the control module 100 is positioned within a holder 170. The holder 170 has upright walls that define an area configured to contain the control module 100 and the electrical conductors 30, and the complementary plugs 116, 118, as described above. The holder 170 may be configured as a bottomless box (i.e., defining only upright side walls) or may be configured as a box having a bottom through which an aperture is formed so that the electrical conductors may be fed through the aperture for coupling to the electrical contacts 110.

Providing complementary plugs 116, 118 to complete the electrical circuits accommodates the comfort level of the consumer who might otherwise be uncomfortable with wiring electrical devices. Such a configuration may be particularly useful in other embodiments where the control module 100 is intended to be used multiple times, such as when the control module 100 is provided to a pyrotechnician hired to oversee a pyrotechnic display ordered separately by a consumer.

The numbering and order of the pyrotechnic devices 12, 14, shown in FIGS. 5A and 5C, is merely exemplary and, of course, the pyrotechnic devices 12, 14 may be numbered or ordered in any desired way. Moreover, fewer or more pyrotechnic devices 12, 14 may be used than the number shown for illustration purposes.

The pyrotechnic module 2 may be ordered by a consumer and built to the consumer's specifications. The pyrotechnic module 2 may be shipped in a carton 80 (as shown in FIG. 6A) or some other suitable shipping container 85, such as a shipping tray 95 with a box cover 90 (as shown in FIG. 6B). Preferably, the dimensions of the carton 80 or the shipping tray 95 are only slightly larger than the dimensions of the mounting board 20. In at least one embodiment, the box cover 90 may be removed at the discharge site 300, thereby exposing the mounting board 20 and the pyrotechnic devices 12, 14 in the shipping tray 95, as shown in FIG. 7. When a carton 80 is used as the shipping container, the pyrotechnic module 2 may be removed from the carton 80 at the discharge site 300.

In one embodiment, the pyrotechnic devices 12, 14, the controller housing 101, and the carton 80 or the shipping tray 95 may be coated with a water-resistant or water-proof coating, such that the pyrotechnic module 2 may withstand exposure to rain, sleet, snow, or water. Alternately, the mounting board 20 and/or the carton 80 or the shipping tray 95 and box 90 may be made of a water-resistant or water-proof material. Further, the carton 80 (or the shipping tray 95), the mounting board 20, the pyrotechnic devices 12, 14, and the control module 100 may be made of materials that are sufficiently buoyant as to float on water, so that the pyrotechnic display may be ignited from a pond or lake.

A process 800 for igniting the pyrotechnic devices 12, 14, using the present system 1000 is illustrated in FIGS. 8A and 8B. When the consumer has located the pyrotechnic module 2 in the desired discharge location 300, he inserts one or more batteries 138 in the battery compartment 148 and enables the wireless functionality on his cellular telephone 200 (or another smart device), in step 805, assuming the functionality is not otherwise active and the transceiver is configured to respond to frequencies in the prescribed wireless range.

In step 810, the consumer turns on the control module 100, using the power (on/off) switch 122 and, optionally, by inserting the key 136 in the key ignition slot 126 and turning the key 136. When the control module 100 is turned on, the one or more lights 124 on the upper surface 102 of the controller housing 101 are illuminated to indicate the successful connections between the electrical contacts 110 and the individual pyrotechnic devices 12, 14.

In step 815, the control module 100 and the smart device (e.g., cellular telephone 200) are paired to one another, such that the control module 100 may receive signals (215) from the smart device (200). The smart device 200 recognizes the particular channel of transmissions from the control module 100. The consumer launches the application 210 that has previously been downloaded on the smart device (200), in step 820. The application includes a script 120 (as shown in FIG. 10) that identifies when each particular pyrotechnic device 12, 14 is scheduled to be ignited. Alternately, the memory of the control module 100 may include the script 120, which is queued up for initiation when the smart device 200 and the control module 100 are paired.

In step 825, the consumer may select the pyrotechnic display to be launched. Step 825 is illustrated as optional, because the application may automatically select the display that corresponds to a unique identification housed in the control module 100. In step 830, because the application 210 is password-protected, the consumer enters a unique password to begin the verification process before the pyrotechnic display is initiated. The consumer may have established the password when he ordered the pyrotechnic module 2 or when the application 210 is downloaded to the smart device 200. Alternately, the password may be provided by the manufacturer with the pyrotechnic module 2 when the module 2 is shipped (for example, by transmitting the password in an e-mail correspondence to the consumer or by including the password in the written operating instructions packaged within the carton 80 or box 90).

Optionally, in step 835, the application 210 prompts the consumer to accept the terms and conditions of use from the manufacturer or supplier of the pyrotechnic module 2.

In step 840, the application 210 prompts the consumer to answer one or more safety questions. The safety questions may ask the consumer to confirm that the pyrotechnic module 2 is placed at a safe distance from spectators, that the pyrotechnic module 2 is not located under trees or near any other ignition sources, that the consumer is a sober adult, and so forth. It is contemplated that the pyrotechnic module 2 is most appropriately located at distances of between 150 feet and 300 feet from the consumer with the smart device 200 and other spectators.

Step 850 and 852 describe the steps necessary to start the pyrotechnic display (that is, to ignite the first pyrotechnic device according to the script 120). For security, the start button may require a two-finger swipe or some other multi-touch entry (step 850). It is believed that such a mechanism prevents ignition of the pyrotechnic devices 12, 14, either by a person who is too young or who is not sober to successfully execute the instructions. In associated step 852, the application 210 provides a "start" or "start show" button on the screen 202 of the smart device 200, which the consumer may depress.

When the consumer has successfully executed the start instructions (steps 850 and 852), the smart device 200 transmits a signal 215 to the transceiver of the control module 100. When the transceiver receives the signal 215, the processor accesses the memory within the control module 100, which includes the ignition instructions 120 for the respective pyrotechnic devices 12, 14 (step 855). In step 860, the control module 100 transmits an electrical charge through the electrical contact 110 and the electrical conductor 30 for the first pyrotechnic device 12 or 14, thereby igniting the first pyrotechnic device 12 or 14. According to timing prescribed within the script 120 of the memory of the control module 100, the control module 100 transmits electrical charges through the electrical contacts 110 and the electrical conductors 30 for each of the remaining pyrotechnic devices 12 or 14 in sequence.

Referring now to FIG. 8B, from the ignition of the first pyrotechnic device 12 or 14 and continuing until all pyrotechnic devices 12 or 14 in the module 2 are launched, the application 210 displays on the screen 202 of the smart device 200 an "emergency stop" button, which may be used in the event that the pyrotechnic display needs to be stopped or paused for some reason (step 870). The "emergency stop" button transmits a signal 215 to the control module 100 to prevent the control module 100 from transmitting an electrical charge to the next scheduled pyrotechnic device 12 or 14.

Moreover, as the pyrotechnic devices 12 or 14 are ignited, the application 210 (in step 875) displays on the screen 202 of the smart device 200 one or more of a status of the pyrotechnic display; a status of at least one of the pyrotechnic devices (e.g., the pyrotechnic device 12 or 14 being currently displayed); a count-down time display of the time associated with the pyrotechnic device 12 or 14 being currently displayed; a count-down time display of time until the ignition of the next pyrotechnic devices 12 or 14; and a count-down time display of the time remaining in the pyrotechnic display. An exemplary screen display 275, including representative information on status of the pyrotechnic display, is shown in FIG. 9.

When the final pyrotechnic device 12 or 14 has been fired, the application 210 (in step 880) displays on the screen 202 of the smart device 200 a "show over" or "complete" message and provides a count-down time display to allow the pyrotechnic module 2 to cool down to a safe temperature for disposal. By way of example, and not limitation, the cool-down period may be in the range of ten to fifteen minutes, depending on the number and type of pyrotechnic devices 12 or 14 having been launched. In step 890, the application 210 displays on the screen 202 of the smart device 200 a warning message (e.g., "do not approach until cool-down period ends") and a disposal message, regarding the safe disposal of the pyrotechnic module 2. Preferably, the battery 138 is removed from the control module 100 before disposal.

FIG. 9 provides a schematic representation of an exemplary status display 275 on the screen 202 of the smart device 200. In this exemplary display 275, the application 210 shows the time remaining in the pyrotechnic display, the time until the ignition of the next pyrotechnic device, and the number of the pyrotechnic device being fired (in this case, device numbered "5"). As described above, the application 210 further displays on the screen 202 the "emergency stop" button 225. Also shown in FIG. 9, the cellular telephone 200 may optionally be provided with a dongle 250 that is removably coupled to the cellular telephone 200 to boost a range of the signal 215 being transmitted by the cellular telephone 200 to the control module 100. The dongle 250 may be packaged with the pyrotechnic display system 1000, for example, in the same shipping tray 95 or carton 80.

FIGS. 10 and 11 illustrate a plan view of three exemplary pyrotechnic modules 2A, 2B, and 2C, as arranged in the discharge area 300. Such an arrangement, using multiple pyrotechnic modules 2, may be used to create a large or longer pyrotechnic display. The control modules 100A, 100B, and 100C of each pyrotechnic module 2A, 2B, and 2C include a channel setting for differentiation in an exemplary firing script 120 (a portion of which is shown in FIG. 11). In the exemplary embodiment shown, the control module 100A for the pyrotechnic display system 2A is set to "Channel 1," while two control modules 100B, 100C for the remaining pyrotechnic display systems 2B, 2C are set to "Channel 2."

The system 2A, 2B, and 2C may be constructed similarly to one another, in that each system includes a control module 100A, 100B, and 100C and a number of pyrotechnic devices 12, 14, which are connected to the respective control module via electrical conductors 30. The number and/or type of pyrotechnic devices 12, 14 may vary from module to module, if desired, to provide variety in the pyrotechnic display.

The control modules 100A, 100B, and 100C of the respective systems 2A, 2B, and 2B can generate a peer-to-peer network among one another (or between the control module 100A and each of the control modules 100B and 100C), when the control modules 100A, 100B, and 100C are powered on.

In one embodiment, when the consumer activates the downloaded application 210 on his smart device 200, the signal 215 transmitted to the control module 100A conveys the firing script 120 to the control module 100A. The firing script 120 includes instructions for the ignition of each of the pyrotechnic devices 12, 14 of each module 2A, 2B, and 2B. The control module 100A transmits the firing script 120 to the control modules 100B and 100C. The control module 100A also transmits a response signal 230 to the smart device 200, so that the timing features of the application 210 remain synchronized with the pyrotechnic display. Alternately, the script 120 may be housed in the memory of one or more of the control modules 100A, 100B, and 100C and may be initiated by the signal 215 from the smart device 200.

A time schedule, which takes into account the duration of each pyrotechnic device, includes a channel setting (e.g., "1" or "2") and a number associated with the pyrotechnic device 12, 14 to be ignited at each particular time. In the exemplary script shown in FIG. 11, at time 00:01, the control module 100A is instructed to ignite the pyrotechnic device labeled "1" in module 2A (channel 1). At time 00:20, the control module 100A is instructed to ignite the pyrotechnic device labeled "2" in module 2A (channel 1). At time 00:30, the control modules 100B and 100C are instructed to ignite the pyrotechnic devices labeled "1" in both modules 2B and 2C (channel 2).

The script 120 continues until all devices 12, 14 are ignited and displayed. It should be understood that multiple pyrotechnic devices 12, 14 from different modules (e.g., 2B, 2C) may be ignited simultaneously. It should further be understood that it is possible to ignite subsequent pyrotechnic devices 12, 14 before the complete display of a prior pyrotechnic device 12, 14. While three modules are depicted in FIGS. 10 and 11, it should be understood that any number of modules 2 (or 2A, 2B, . . . 2Z) may be employed with the script 120 being written to accommodate any number of modules 2 and associated pyrotechnic devices 12, 14. Thus, the present pyrotechnic ignition system 1000 provides great flexibility in size and duration of the pyrotechnic display created, while being safe and easy to use for the consumer.

As described herein, in one embodiment of the present disclosure, the control module 100 is permanently mounted to the mounting board 20 and is intended for single-use with a single pyrotechnic display. In another embodiment of the present disclosure, the control module 100 may be removably mounted within a designated area 28 of the mounting board 20, and the control module 100 is configured to perform the firing sequence only a single time. In both of these embodiments, the control module 100 is a single-use, or disposable, unit.

In another embodiment of the present disclosure, the control module 100 may be removably mounted in the designated area 28 in the mounting board 20, and may be re-used with a subsequent pyrotechnic display. In this embodiment, the control module 100 includes the memory on which the script 120 is stored, and the application 210 retrieves the timing sequence (i.e., the script 120) for each pyrotechnic display from the memory of the control module 100.

The present pyrotechnic display system and control module address many potential impediments to the enjoyment of a high quality pyrotechnic display by the do-it-yourself fireworks enthusiast. The present system provides a safe configuration of the pyrotechnic devices by having the pyrotechnic devices securely affixed to a mounting substrate and by having the pyrotechnic devices pre-wired to the control module. In addition to reducing the likelihood of incidental contact dislodging the electrical conductors, disposing the electrical conductors beneath the mounting substrate reduces the likelihood that a stray spark falling from the pyrotechnic display will land on one of the electrical conductors and sever the electrical connection.

Because the pyrotechnic devices are pre-wired before the pyrotechnic display system is shipped to the consumer, the consumer is not burdened with individually wiring an electrical conductor for each individual pyrotechnic device to a corresponding electrical contact. Thus, the set-up time for the consumer is significantly reduced, and the comfort level for the consumer is significantly increased.

The present pyrotechnic display system also alleviates the consumer's burden of selecting complementary pyrotechnic devices from a wide array of commercially available pyrotechnic devices. The consumer does not have to familiarize himself with the color, sound level, and effect produced for many different pyrotechnic devices and, additionally, does not have to speculate on which pyrotechnic devices displayed in which order would produce an aesthetically pleasing display.

When the display from the present pyrotechnic display system is completed, the consumer waits for the appropriate time to allow the system to cool down. Optionally, he can spray the discharged pyrotechnic devices with water. Then, the consumer has the convenience of picking up the shipping tray and/or mounting board and disposing of the shipping tray, the discharged pyrotechnic devices, any debris from the discharged pyrotechnic devices, and the control module. Optionally, the consumer may remove the battery from the battery compartment of the control module before discarding the shipping tray containing the pyrotechnic module and control module.

Finally, the pyrotechnic display system provides consumers with a professional, easy-to-use pyrotechnic display that is affordable, even for a single use. The consumer is not required to pay hundreds or thousands of dollars for complicated, professional-grade control modules and auxiliary equipment. Further, the consumer is not required to purchase a dedicated and expensive remote control to interact with the control module or the pyrotechnic devices.

The preceding discussion only illustrates the principles and benefits of the present pyrotechnic display system and control module. It will be appreciated that those skilled in the art may be able to devise various arrangements, which, although not explicitly described or shown herein, embody the principles of the invention and are included within its spirit and scope. Furthermore, all examples and conditional language recited herein are principally and expressly intended to be for educational purposes and to aid the reader to understand the principles of the present pyrotechnic display system and associated control module, and the concepts contributed by the inventor to furthering the art and are to be construed as being without limitation to such specifically recited examples and conditions. For example, the number and type of pyrotechnic devices, the type of smart device employed as a remote control, and the specific information displayed by the application on the smart device may vary in numerous ways to fit various circumstances, but such modifications are intended to fall within the teaching and spirit of the present disclosure.

Moreover, all statements herein discussing principles, aspects, and embodiments of the invention, as well as specific examples thereof, are intended to encompass both structural and functional equivalents thereof. Such equivalents include both currently known and equivalents developed in the future, i.e., any elements developed that perform the same function, regardless of structure. Terms, such as "application", "display", "smart device", and the like, are intended only to aid in the reader's understanding of the principles and drawings and are not to be construed as limiting the invention being described to any particular orientation, matter or configuration, unless recited in the claims.

This description of the exemplary embodiments is intended to explain the new system in connection with the accompanying drawings, which are to be considered part of the entire description of the invention. The foregoing description provides a teaching of the subject matter of the appended claims, including the best mode known at the time of filing, but is in no way intended to preclude foreseeable variations contemplated by those of skill in the art.

The exemplary embodiments may be described in claims such as those appended hereto.

What is claimed is:

1. A consumer-ready pyrotechnic display system comprising:

a pyrotechnic module comprising:

a mounting substrate;

a plurality of electrically ignitable pyrotechnic devices fixedly secured to the mounting board; and a plurality of electrical conductors, each electrical conductor being in electrical communication with a respective one of the plurality of pyrotechnic devices and disposed beneath the mounting substrate; and a control module attached to the mounting substrate, the control module comprising:

a housing having an upper surface and a bottom surface opposite the upper surface;

a processor, a memory, a power supply, and a transceiver within the housing; and a plurality of electrical contacts solely disposed on the bottom surface of the housing inaccessible by a consumer of the pyrotechnic display system;

wherein the electrical conductors are connected to the electrical contacts prior to receipt by the consumer; and wherein, upon the transceiver receiving a signal from a remote device, the processor ignites each of the electrical conductors in a sequence programmed into the memory of the control module.

2. The pyrotechnic ignition system of claim 1, wherein the control module is permanently affixed to the mounting substrate.

3. The pyrotechnic ignition system of claim 1, wherein the mounting substrate defines a feed aperture therethrough proximate to the control module, the plurality of electrical conductors being fed through the feed aperture from beneath the mounting substrate for connection to the electrical contacts.

4. The pyrotechnic ignition system of claim 1, further comprising a shipping container sized to house the mounting substrate therein; and wherein at least the mounting substrate is water-resistant or water-proof or coated with a water-resistant coating.

5. The pyrotechnic ignition system of claim 1, further comprising an on/off switch in communication with the processor.

6. The pyrotechnic ignition system of claim 1, further comprising an ignition key switch in communication with the processor.

7. The pyrotechnic ignition system of claim 1, wherein the power supply comprises a battery in communication with the control module;

wherein the battery is removably mounted within a battery compartment on the upper surface of the housing of the control module, the battery compartment having a first battery terminal and a second battery terminal complementary to the battery; and wherein the battery compartment includes a removable tab positioned therein to close the circuit between the first battery terminal and the second battery terminal prior to installation of the battery.

8. The pyrotechnic ignition system of claim 1, wherein the transceiver is configured to receive and transmit radio frequency signals.

9. The pyrotechnic ignition system of claim 1, wherein the remote device is a handheld device or a wearable device of a consumer, the remote device being provided with an application configured with a user interface to facilitate communication with the control module; and wherein the control module responds to one or more instructions from the consumer, the one or more instructions being conveyed through the user interface of the application.

10. The pyrotechnic ignition system of claim 9, wherein the application is password-protected.

11. The pyrotechnic ignition system of claim 9, wherein the remote device is one of a cellular telephone, a tablet computer, a smart watch, and a wearable computer peripheral device in the form of eyeglasses.

12. The pyrotechnic ignition system of claim 11, wherein the remote device is a cellular telephone.

13. The pyrotechnic ignition system of claim 9, wherein the application is configured, when executed, to communicate a first instruction of the one or more instructions to the control module to initiate a start of a pyrotechnic display; and wherein the control module, upon receipt of the first instruction, electrically ignites a first pyrotechnic device of the plurality of pyrotechnic devices.

14. The pyrotechnic ignition system of claim 13, wherein the application is configured, when executed, to require acknowledgement of at least one safety question before communication of the instruction to the control module to initiate the start of the pyrotechnic display.

15. The pyrotechnic ignition system of claim 14, wherein the remote device is a cellular telephone; and wherein the application is configured, when executed, to require a two-finger swipe or multi-step entry before communication of the instruction to the control module to initiate the start of the pyrotechnic display.

16. The pyrotechnic ignition system of claim 9, wherein the memory of the control module is configured to communicate to the processor the one or more instructions individually in a timed sequence for the ignition of respective pyrotechnic devices of the plurality of pyrotechnic devices; and wherein each individual instruction of the one or more instructions causes the processor to electrically ignite a respective pyrotechnic device of the plurality of pyrotechnic devices.

17. The pyrotechnic ignition system of claim 9, wherein the user interface displays one or more of a status of the pyrotechnic display, a status of at least one of the pyrotechnic devices, a time display of the pyrotechnic device being displayed, a count-down time display of time until a subsequent pyrotechnic device is ignited, a count-down time display of time remaining until a final pyrotechnic device is completed, and an emergency stop button.

18. The pyrotechnic ignition system of claim 9, wherein the user interface displays a message indicating a completed status of the pyrotechnic display and a count-down time display of time remaining for a cool-down of the pyrotechnic devices.

19. The pyrotechnic ignition system of claim 9, wherein the user interface displays a message regarding the proper disposal of the pyrotechnic devices; and wherein the pyrotechnic module and the control module are configured for easy disposal.

20. The pyrotechnic ignition system of claim 1, wherein the control module is disposable.

* * * * *